US009004283B1

(12) United States Patent
Lozano

(10) Patent No.: US 9,004,283 B1
(45) Date of Patent: Apr. 14, 2015

(54) CARRIER FOR SOLUTION FOR CLEANING GOLF CLUBS AND OTHER ESSENTIALS

(76) Inventor: Roberto Lozano, North Baltimore, OH (US)

( * ) Notice: Subject to any disclaimer, the term of this patent is extended or adjusted under 35 U.S.C. 154(b) by 560 days.

(21) Appl. No.: 13/464,822

(22) Filed: May 4, 2012

Related U.S. Application Data

(63) Continuation-in-part of application No. 12/616,546, filed on Nov. 11, 2009, now abandoned.

(51) Int. Cl.
*B65D 85/20* (2006.01)
*A45C 13/02* (2006.01)

(52) U.S. Cl.
CPC ..... *A45C 13/02* (2013.01)

(58) Field of Classification Search
USPC ..... 206/315.1, 315.2, 361, 362.2, 362.3, 206/223, 579; 15/106, 21.2; 401/137
See application file for complete search history.

(56) References Cited

U.S. PATENT DOCUMENTS

| | | | | |
|---|---|---|---|---|
| 4,464,072 | A | 8/1984 | Norwell | |
| 5,105,958 | A | 4/1992 | Patton | |
| 5,161,683 | A * | 11/1992 | Smith | 206/315.1 |
| 5,230,117 | A | 7/1993 | Johnson | |
| 6,003,663 | A * | 12/1999 | Newcomer | 206/5 |
| 7,090,075 | B1 * | 8/2006 | Rocha | 206/315.2 |

* cited by examiner

*Primary Examiner* — Jacob K Ackun
(74) *Attorney, Agent, or Firm* — Jerry Semer

(57) ABSTRACT

The device is a holder. Within the holder is a cleaning solution for cleaning the face of the golf club. Attach to the holder is a bristle brush. The holder clips to a golf bag. The golfer after each shot takes the container of clean solution and puts some solution on the face of the club and cleans the face of the club with the bristle brush. On the holder is a place to hold golf tees and a divot fixer and ball marker.

16 Claims, 8 Drawing Sheets

CARRIER FOR SOLUTION FOR CLEANING GOLF CLUBS AND OTHER ESSENTIALS

Figure 1:
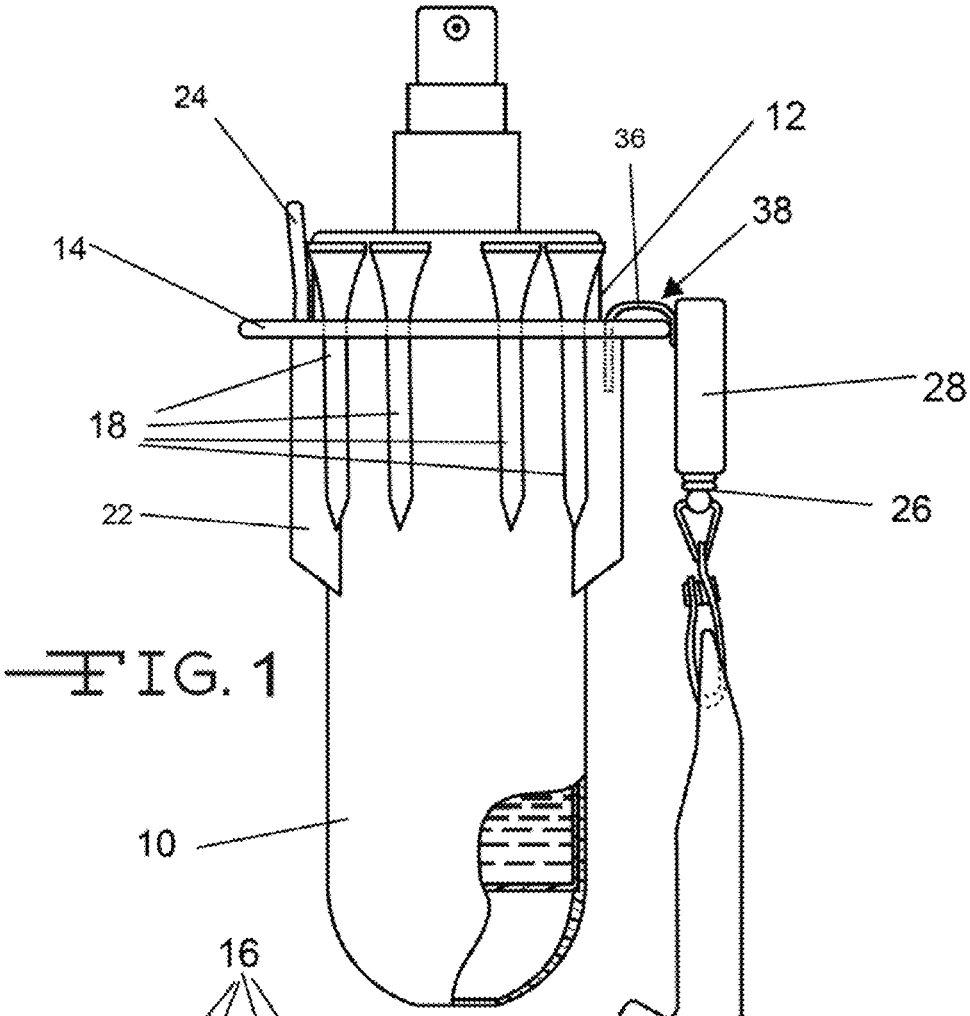

This application is a continuation in part of prior application Ser. No. 12/616,546 filed Nov. 11, 2009.

TECHNICAL FIELD OF THE INVENTION

The present invention relates to the general art of organizational carriers for golf that allows one to carry essential items for playing golf and cleaning clubs while playing that is easily accessible while playing golf, and more particularly to a device that attaches to a golf bag that carries essential items for playing golf and items for cleaning clubs while playing.

BACKGROUND OF THE INVENTION

Most professional golfers are very fastidious at keeping their golf clubs and golf balls clean while playing a round of golf. Most caddies clean the club that has been used before moving to the next shot. The club is again whipped off just before it is used for another shot. Most amateurs who do not have caddies hardy ever whip off there clubs before or after a shot. The professionals know that in the game of golf, it is very important for the face of a golf club to be clean and free from dirt, grass and the like. In particular, it is important that the grooves on the club face be free of foreign matter before the club face makes contact with the golf ball. These grooves which dig into the golf ball when the clubs face hits the ball enables the golfer to maintain directional accuracy and/or attain a top spin or back spin on the golf ball as desired. The groves allow the golfer to place controlled spin on the ball to cause it to hook, slice or rise at the golfer direction. Dirt and grass in the groves or on the club will dig in the ball being stroked and place a spin contrary to what the golfer wanted. This may cause the ball to slice or hook unwontedly.

It is also important for the golf club face to be clean from any dirt or grasses in that this foreign matter reduces the impact force of the golf club hitting the golf ball, thereby reducing the amount of distance a ball will travel. Another reason for keeping club faces clean is to prevent rusting or pitting. The rust or pits of the club face will upon impact with the golf ball will place a spin on the ball contrary to the golfer wish and cause the ball to hook or slice differently than the golfer desired. Rusting and pitting of the clubs face also causes the golf club or clubs to loose resale value and longevity.

By cleaning one's club after each shot, a golfer shots will be more true and accurate. Thus, a golfer will be able to improve his golf game without any additional a practice on improving his technique.

Current methods of maintaining a clean club face range from using a wet towel and cleaning the club face after each time the club is used, or scraping the club face with a golf tee. Unfortunately, the above described methods have several drawbacks. First, cleaning a club face with a wet towel tends to quickly ruin the towel and does not insure that each entire groove of the club face is cleaned. Also, the golfers' hands become wet, which might interfere with the gripping of the club. Likewise, scraping the grooves with a tee does not insure that all dirt and grass are removed from the club face and the scraping action might also damage the club face.

Another method of keeping a club face clean is to use a carbide-tipped scraper after each use of the club. Although carbide-tipped scrapers are effective in cleaning the club face and grooves, they tend to wear off the protective finish of the club face, thereby causing the club face to become pitted or rusted. Furthermore, these various types of scrapers tend to become easily lost or misplaced.

Manually-operated brush devices are also available and are typically installed at the golf course on the first tee. However, these manual devices are of no use out on the golf course when a club is used repeatedly. Additionally, other portable manual brush devices tend to require a large amount of exertion by the golfer, thereby causing the golfer to prematurely tire while playing a round of golf.

Based upon the foregoing, it is evident that a convenient, light weight and easy-to-use portable golf club cleaner will sell. Furthermore, the cleaner must be designed so that it can easily be carried by the golfer. Further it must be designed so that it will not be easily lost. It must be in plain site to the golfer and easy when playing a round of golf to reach and put away. There is also a need in the art for a portable golf club cleaner that is easily secured to a golf bag or golf cart and wherein the parts of the golf club cleaner can be easily replaced.

These, objectives are achieved by the features of a container that clips to the golf bag. Attach to the container is a brush that is designed to clean the face of a golf club and the groves upon that face. The container contains a solution that is used to clean the golf clubs. The container also contains a place for a golfer tees and ball markers. This unit not only is used to clean golf clubs, it reminds the golfer to clean the golf clubs so better shots will be made.

The container has also been designed to carry golf tees and a ball marker and divot fixer. This enables a golfer to play a whole round of golf and only have to reach into his golf bag for his clubs.

SUMMARY OF THE INVENTION

The device which is designed by the inventor enables a golfer to clean his golf club after each stroke and thus causes the ball to fly straighter and with the desired spin, is a holder. Within the holder is a cleaning solution for cleaning the face of the golf club. Attach to the holder is a bristle brush. The holder clips to a golf bag. The golfer after each shot takes the container of clean solution and puts some solution on the face of the club and cleans the face of the club with the bristle brush. On the holder is a place to hold golf tees and a divot fixer and ball marker.

BRIEF DESCRIPTION OF THE DRAWING FIGURES

Figure 5:
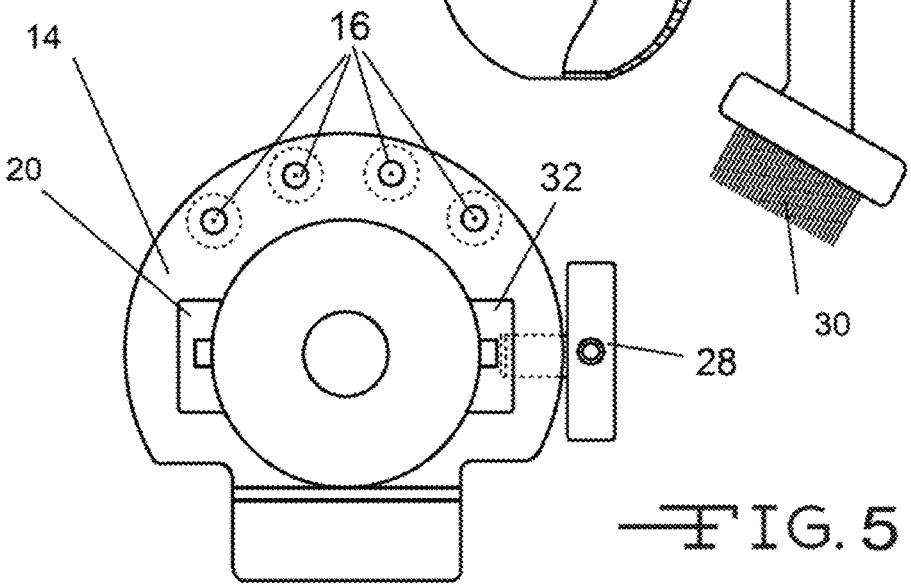
Figure 2:
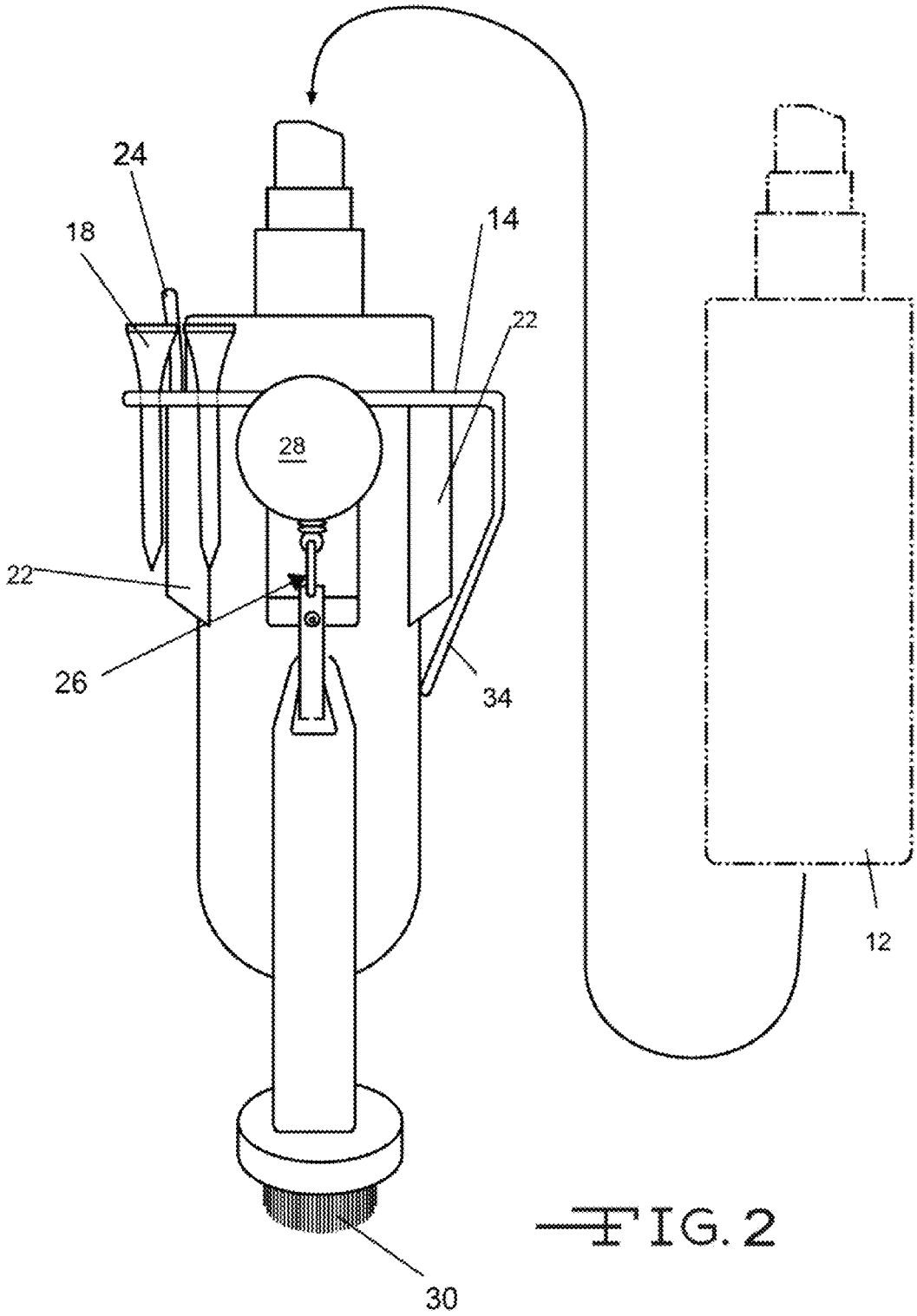
Figure 3:
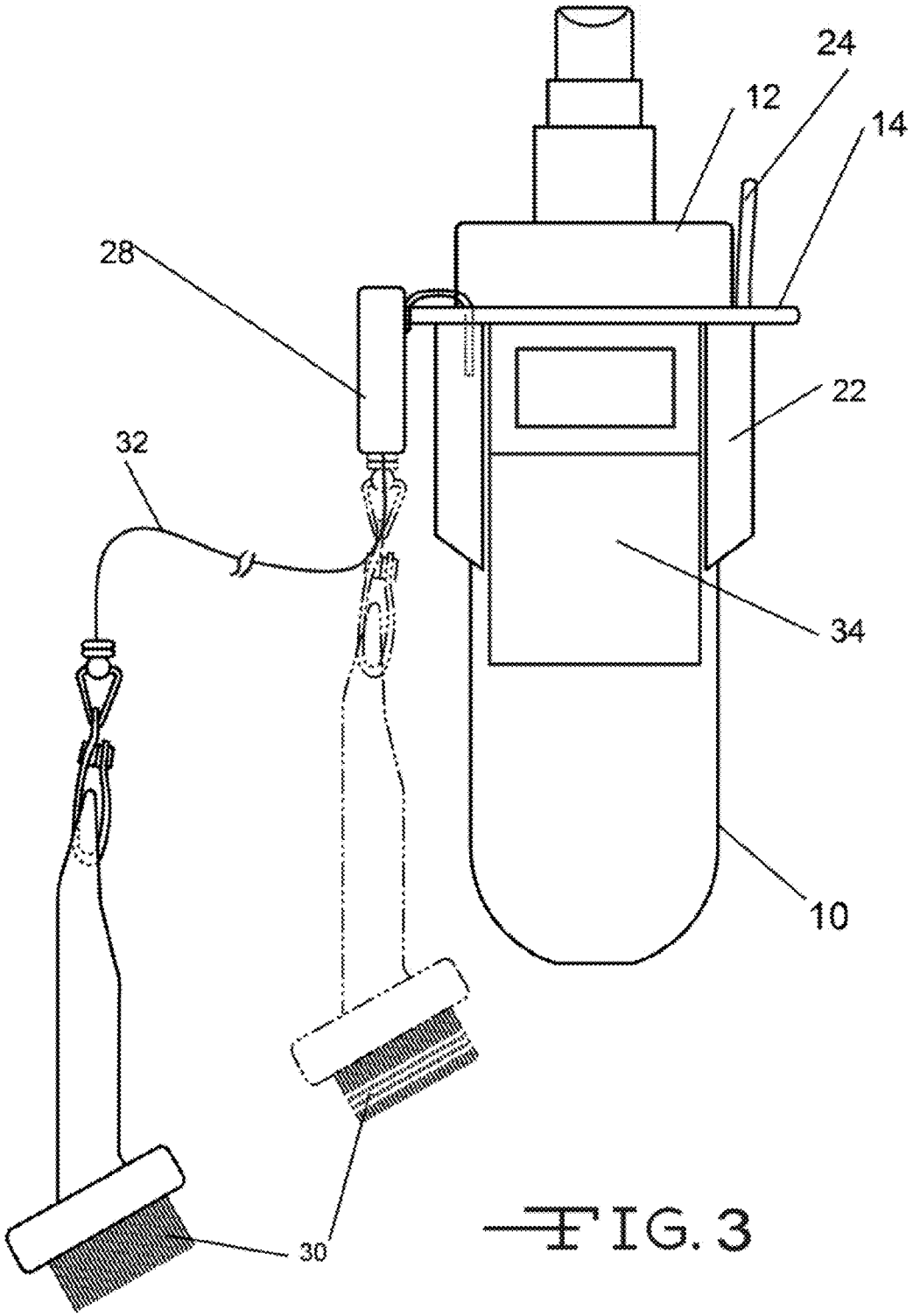
Figure 4:
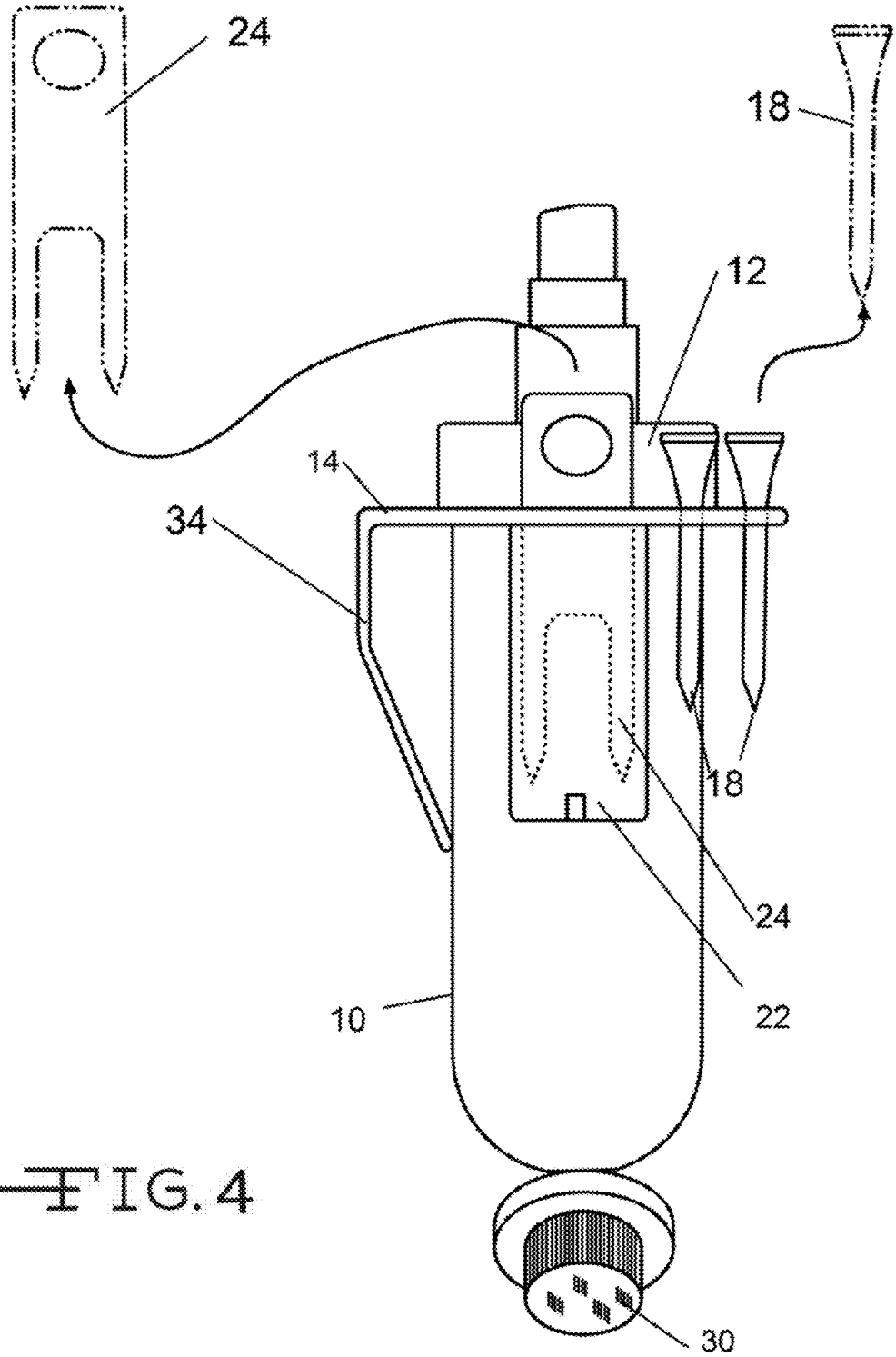
Figure 6:
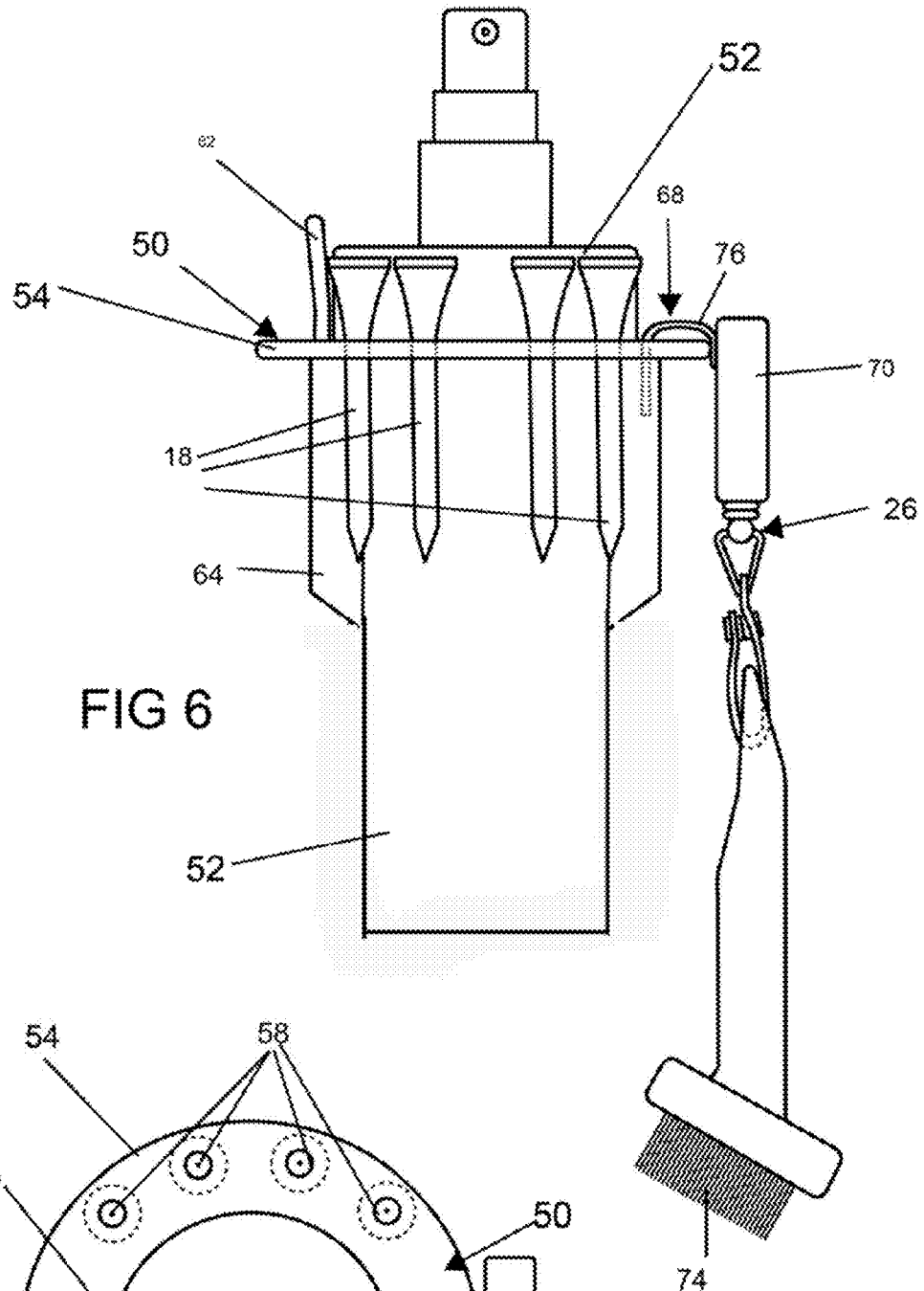
Figure 10:
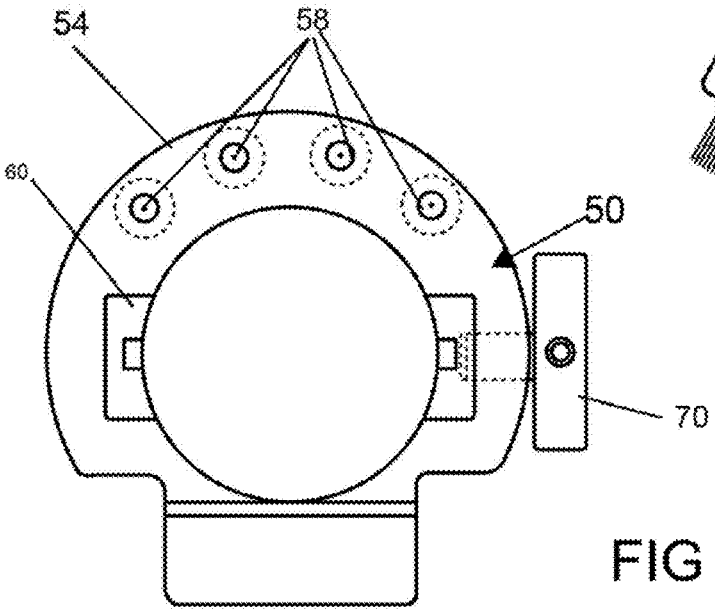
Figure 7:
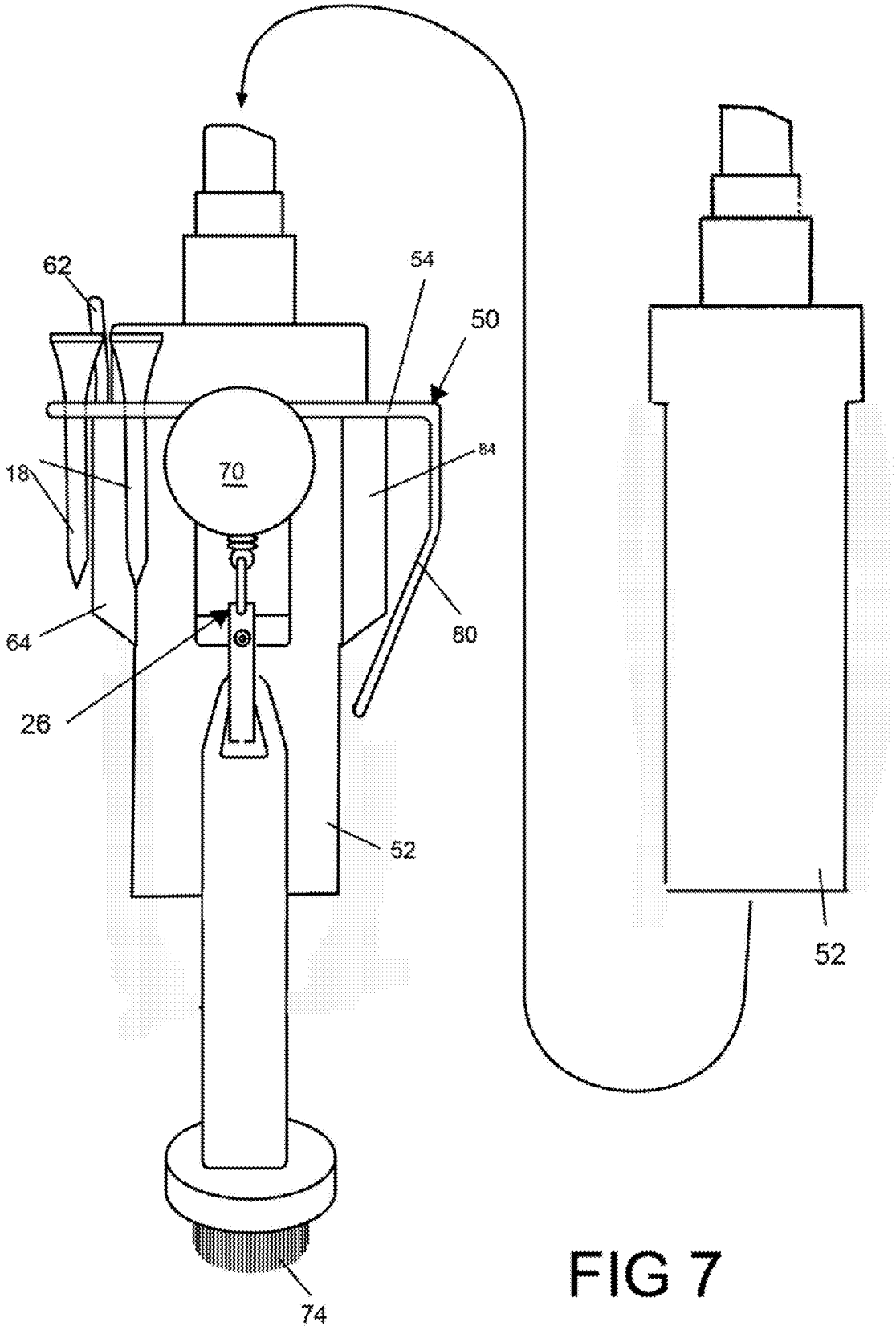
Figure 8:
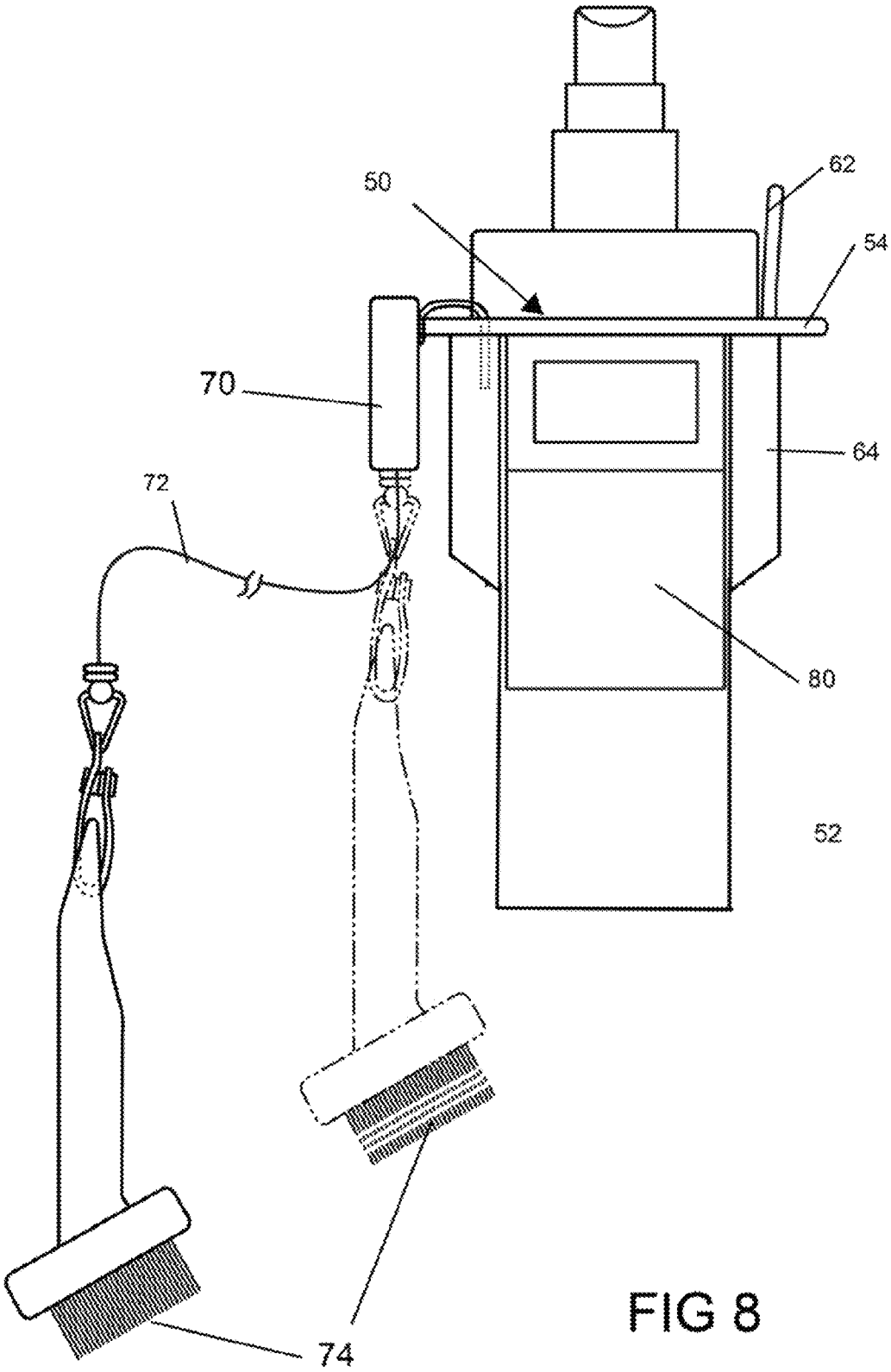
Figure 9:
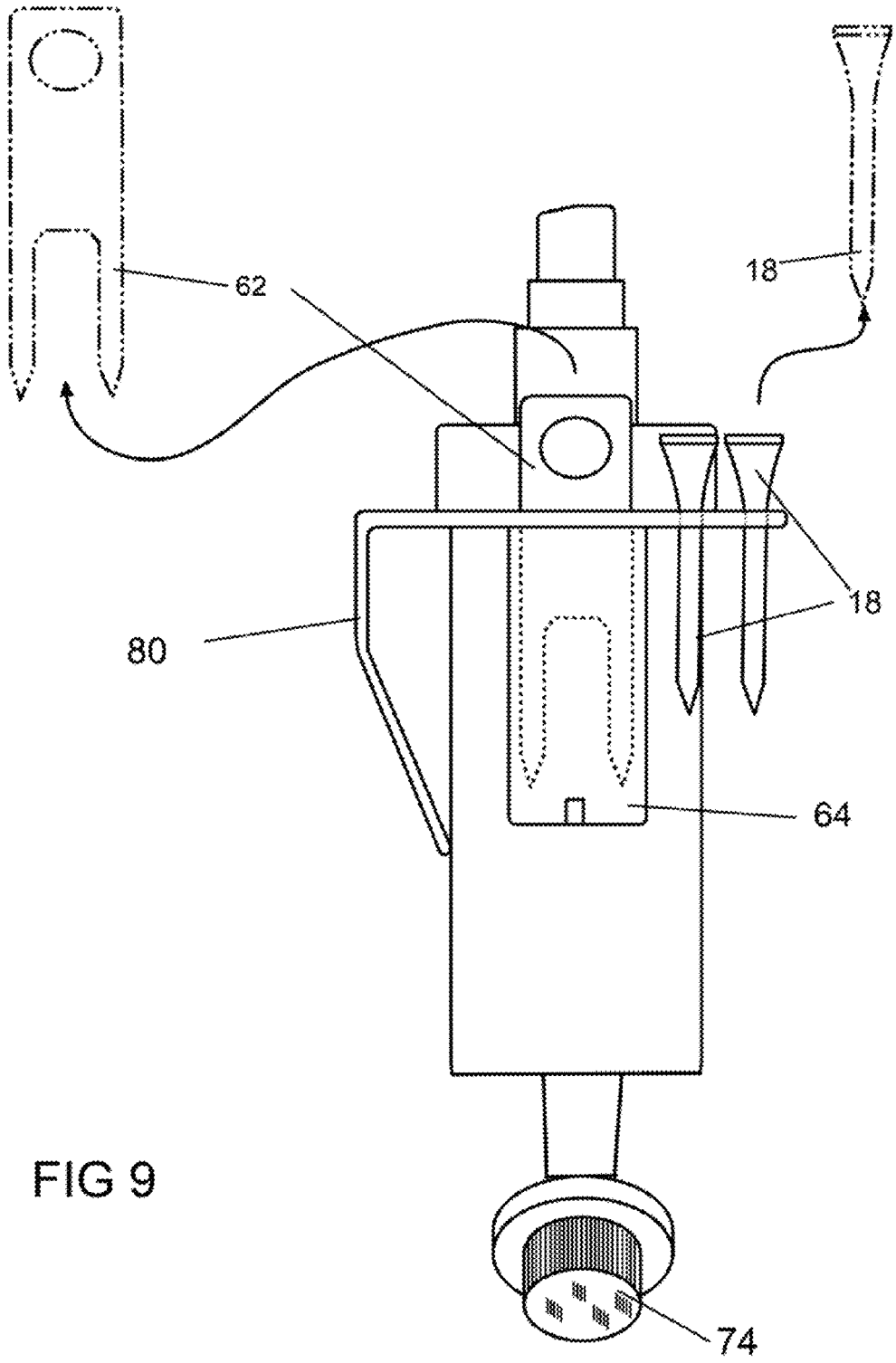

FIG. 1 is a front view of the invention.
FIG. 2 is a side view of the invention.
FIG. 3 is a back view of the invention.
FIG. 4 is a view of the other side of the invention.
FIG. 5 is a top view of the invention.
FIG. 6 is a front view of another embodiment the invention.
FIG. 7 is a side view of another embodiment the invention.
FIG. 8 is a back view of another embodiment the invention.
FIG. 9 is a view of the other side of another embodiment the invention.
FIG. 10 is a top view of another embodiment the invention.

DETAILED DESCRIPTION OF THE PREFERRED EMBODIMENT OF THE INVENTION

Other objects, features and advantages of the invention will become apparent from a consideration of the following detailed description and the accompanying drawings.

FIG. 1 is a front view of the invention. FIG. 1 shows a holder 10 that is designed to hold a spray bottle 12. In the preferred embodiment the holder 10 is cylindrical but it can be any shape as long as it is designed to hold a spray bottle 12. Near the top of the holder 10 is a ridge 14. On the ridge 14 are openings 16 that can best be seen in FIG. 5. These openings are circular in shape and are designed to hold golf tees 18. The openings are of a size that the bottom of the golf tee 18 will fit securely within. However the openings are small enough that the top of the tee will not pass through. Also in FIG. 5 one can see that the ridge 14 also has a rectangular opening 20. The rectangular opening is designed to carry a ball marker and divot fixer. FIG. 1 shows that the rectangular opening 20 is the top of a rectangle box 22 that sits alongside the holder 10. The rectangular box 22 is of a length, width, and depth sufficient that it can hold the ball marker and divot fixer 24. FIG. 1 also shows attached to the ridge 14 a brush assembly 26. In the embodiment shown in FIG. 1 the brush assembly is attached to the ridge 14 by a clamp 18. The clamp 18 is attached to a cord recoiler 28. The cord 32 of the cord recoiler 28 is attached to the brush 30 as shown in FIG. 3. FIG. 3 shows that the cord 32 can be pulled out of the cord recoiler 28 to facilitate use of the brush 30. The brush 30 has the necessary stiffness that it can brush away the dirt on a golf club face when the golf club has been used. The clamp 18 extends out of the cord recoiler 28 and over the ridge 14. In this embodiment the ridge 14 has a rectangular opening 34 on the side on which the cord recoiler 28 is attached. The clamp 38 comprises a piece of metal 36 that is bent to fit over the ridge and into the rectangular opening 34. The piece of metal 36 holds the cord recoiler 28 to the invention by spring tension. The cord recoiler 28 could be attached to the invention in many different ways. In this embodiment the cord recoiler 28 is attached to the ridge 14. However it could be attached to the holder 10.

FIGS. 2 and 4 show a side view of the invention. They also show the side view of the clip 34. The clip 34 is designed such that it will attach the invention to the top of a golf bag. The clip 34 fits over the top edge of the golf bag. In the embodiment shown in FIGS. 2 and 4 the clip 34 is attached to the invention via ridge 14. The clip 34 however could be attached directly to the holder 10. The clip 34 extends outward from the ridge a sufficient distance that the clip 34 can fit over the top edge of a golf bag. The clip 34 then extends downward for a distance then turns towards the holder 10. This enables the clip 34 when placed over the top edge of a golf bag to securely hold the invention to the golf bag.

FIG. 5 the top view of the invention shows the clip 34 extending out on the back of the ridge 14 and the holder 10. FIG. 3 the back view of the invention shows the clip 34 on the back of the invention.

FIG. 6 is a front view of a second embodiment of the invention. FIG. 6 shows a holder 50 that is designed to hold a spray bottle 52. In the preferred embodiment the holder 50 has a disk shaped top 54 with an opening 56 in the middle that is of sufficient size to hold the spray bottle 52. FIG. 7 shows that the spray bottle 52 is cantilever in shape. The circumference of the bottom of spray bottle 52 is sufficiently small that it will fit through the opening 56. However, the circumference of the top of spray bottle 52 is larger than the opening 56. Thus, the shape of the spray bottle 52 holds the spray bottle 52 in place within opening 56.

FIG. 10 the top view of the invention shows the holder 50 has holes 58 around the front of the disk shaped top 54. These holes 58 are circular in shape and are designed to hold golf tees 18. The holes 58 are of a size that the bottom of the golf tee 18 will fit securely within. However the holes 58 are small enough that the top of the tee will not pass through. Also in FIG. 7 one can see that the disk shaped top 54 of holder 50 also has a rectangular opening 60. The rectangular opening 60 is designed to carry a ball marker and divot fixer 62. FIG. 6 shows that the rectangular opening 60 is the top of a rectangle box 64 that extends downward from the disk shape top 54. The rectangular box 64 is of a length, width, and depth sufficient that it can hold the ball marker and divot fixer 62.

FIG. 6 also shows attached to the disk shaped top 54 is a brush assembly 66. In the embodiment shown in FIG. 6 the brush assembly 66 is attached to the disk shaped top 54 by a clamp 68. The clamp 68 is attached to a cord recoiler 70. The cord 72 of the cord recoiler 70 is attached to the brush 72 as shown in FIG. 3. FIG. 3 shows that the cord 72 can be pulled out of the cord recoiler 70 to facilitate use of the brush 74. The brush 74 has the necessary stiffness that it can brush away the dirt on a golf club face when the golf club has been used.

The clamp 68 extends out of the cord recoiler 70 and over disk shaped top 54. In this embodiment the disk shaped top 54 has a rectangular opening 74 on the side on which the cord recoiler 70 is attached. The clamp 68 comprises a piece of metal 76 that is bent to fit over the disk shaped top 54 and into the rectangular opening 74. The piece of metal 76 holds the cord recoiler 70 to the invention by spring tension. The cord recoiler 70 could be attached to the invention in many different ways.

FIGS. 8 and 9 show a side view of the invention. They also show the side view of the clip 80. The clip 80 is designed such that it will attach the invention to the top of a golf bag. The clip 80 fits over the top edge of the golf bag. In the embodiment shown in FIGS. 8 and 9 the clip 80 is attached to the back of the disk shaped top 54. The clip 80 extends outward from the disk shaped top 54 a sufficient distance that the clip 80 can fit over the top edge of a golf bag. The clip 80 then extends downward for a distance then turns towards downward extension 84. Downward extension 84 extends downward from the disk shaped top 54. This enables the clip 80 when placed over the top edge of a golf bag to securely hold the invention to the golf bag by pressing the golf bag against downward extension 84.

FIG. 10 the top view of the invention shows the clip 80 extending out on the back of the disk shaped top 54. FIG. 9 the back view of the invention shows the clip 80 on the back of the invention.

Changes and modifications in the specifically described embodiments can be carried out without departing from the scope of the invention which is intended to be limited only by the scope of the appending claims.

I claim:

1. A device for carrying essential item in an accessible way for playing golf comprising:

a. a disk with an opening in the center; and, b. a container having an open top extending downward from the center of the disk such that the open top of the container is the opening in the center of the disk and the container is of a size sufficient to hold a bottle; and, c. a cord attached to the disk, and, d. a bristle brush attach to a loose end of the cord and said cord is of sufficient length that the bristle brush can be use comfortably to clean the face of the head of a golf club while playing golf; and e. a clip that attaches to the disk and said clip clips to the top edge of a golf bag and holds the disk and container securely and non-permanently to the golf bag.

2. A device for carrying essential item in an accessible way for playing golf as in claim 1 further comprising:

a. a bottle containing cleaning solution that is able to fit within the container; and, b. a mechanism for dispensing the cleaning solution within the bottle, attached to the bottle.

3. A device for carrying essential item in an accessible way for playing golf as in claim 1 further comprising:

a. openings in the disk of a size that golf tee bottom will fit through but the top will not fit through.

4. A device for carrying essential item in an accessible way for playing golf as in claim 2 further comprising:

a. openings in the disk of a size that golf tee bottom will fit through but the top will not fit through.

5. A device for carrying essential item in an accessible way for playing golf as in claim 1 further comprising:

a. an opening in the disk that is of a sufficient size that a ball marker and divot fixer will pass through; and b. a box extending downward from the opening in the disk such that the open top of the box is the opening in the disk and the box is of a length, width, and depth sufficient that it can hold the ball marker and divot fixer with enough of the ball marker and divot fixer protruding above the disk that the ball marker and divot fixer can be griped and removed from the box.

6. A device for carrying essential item in an accessible way for playing golf as in claim 4 further comprising:

a. an opening in the disk that is of a sufficient size that a ball marker and divot fixer will pass through; and b. a box with an open top extending downward from the opening in the disk such that the open top of the box is the opening in the disk and the box is of a length, width, and depth sufficient that it can hold the ball marker and divot fixer with enough of the ball marker and divot fixer protruding above the disk that the ball marker and divot fixer can be griped and removed from the box.

7. A device for carrying essential item in an accessible way for playing golf as in claim 1 further comprising:

a. a cord recoiler attached to the disk and said cord recoiler contains the cord that is attach to the brush.

8. A device for carrying essential item in an accessible way for playing golf as in claim 6 further comprising:

a. a cord recoiler attached to the disk and said cord recoiler contains the cord that is attach to the brush.

9. A device for carrying essential item in an accessible way for playing golf as in claim 8 wherein:

a. The disk is made of plastic.

10. A device for carrying essential item in an accessible way for playing golf comprising:

a. a disk with an opening in the center; and, b. a bottle containing cleaning solution and said bottle's shape enable it to fit and be held security within the opening in the center of the disk; and, c. a mechanism for dispensing the cleaning solution within the bottle, attached to the bottle; and, d. a cord attached to the disk, and, e. bristle brush attach to the loose end of the cord and said cord is of sufficient length that the bristle brush can be use comfortably to clean the face of the head of a golf club while playing golf; and f. a clip that attaches to disk and said clip clips to the top edge of a golf bag and holds the disk and container securely and non-permanently to the golf bag.

11. A device for carrying essential item in an accessible way for playing golf as in claim 10 further comprising:

a. openings in the disk of a size that golf tee bottom will fit through but the top will not fit through.

12. A device for carrying essential item in an accessible way for playing golf as in claim 10 further comprising:

a. an opening in the disk that is of a sufficient size that a ball marker and divot fixer will pass through; and b. a box with an open top extending downward from the opening in the disk such that the open top of the box is the opening in the disk and the box is of a length, width, and depth sufficient that it can hold the ball marker and divot fixer with enough of the ball marker and divot fixer protruding above the disk that the ball marker and divot fixer can be griped and removed from the box.

13. A device for carrying essential item in an accessible way for playing golf as in claim 11 further comprising:

a. an opening in the disk that is of a sufficient size that a ball marker and divot fixer will pass through; and b. a box with an open top extending downward from the opening in the disk such that the open top of the box is the opening in the disk and the box is of a length, width, and depth sufficient that it can hold the ball marker and divot fixer with enough of the ball marker and divot fixer protruding above the disk that the ball marker and divot fixer can be griped and removed from the box.

14. A device for carrying essential item in an accessible way for playing golf as in claim 10 further comprising:

a. a cord recoiler attached to the disk and said cord recoiler contains the cord that is attach to the brush.

15. A device for carrying essential item in an accessible way for playing golf as in claim 11 further comprising:

a. a cord recoiler attached to the disk and said cord recoiler contains the cord that is attach to the brush.

16. A device for carrying essential item in an accessible way for playing golf as in claim 13 further comprising:

a. a cord recoiler attached to the disk and said cord recoiler contains the cord that is attach to the brush.

* * * * *